United States Patent [19]

Townsley

[11] Patent Number: 4,655,451

[45] Date of Patent: Apr. 7, 1987

[54] GOLFER'S AID APPARATUS AND METHOD OF USE THEREOF

[75] Inventor: Peter A. Townsley, Atlanta, Ga.

[73] Assignee: Omni Concepts, Inc., Atlanta, Ga.

[21] Appl. No.: 579,579

[22] Filed: Feb. 13, 1984

[51] Int. Cl.[4] ..... A63B 69/36

[52] U.S. Cl. ..... 273/32 H; 273/176 L

[58] Field of Search ..... 273/32 H, 176 L, 185 R; 434/252; 283/34; 33/174 F, 174 G

[56] References Cited

U.S. PATENT DOCUMENTS 3,523,689 8/1970 Cornell et al. ..... 273/176 L 3,937,466 2/1976 Candor ..... 273/32 H

*Primary Examiner*—George J. Marlo

*Attorney, Agent, or Firm*—Jones & Askew

[57] ABSTRACT

A golfer's aid apparatus and method of use thereof wherein a golfer is informed of the distance over which a particular golf shot is to be played, and assisted in selecting the preferred club to be played by that golfer for that particular golf shot. The apparatus of the present invention includes a diagrammatic representation of an actual hole to be played by a golfer and a shooting pattern for that golfer disposed on a transparent overlay. The shooting pattern comprises a visual summary of the ability of that golfer to play each of a plurality of golf clubs. The method of the present invention includes the steps of diagramming an actual golf hole to be played by the golfer, diagramming a shooting pattern for that golfer showing the maximum and minimum distance and the maximum dispersion achieved by that golfer when playing each of a defined set of golf clubs, and superimposing the shooting pattern for that golfer onto the golf hole diagram so that the golfer may select the preferred club to play a particular golf shot according to his or her own ability by visual inspection.

2 Claims, 5 Drawing Figures

GOLFER'S AID APPARATUS AND METHOD OF USE THEREOF

TECHNICAL FIELD

The present invention relates generally to the sport of golf, and more particularly relates to an apparatus and method that enables a golfer to select the preferred golf club for playing a particular shot according to his or her own ability.

BACKGROUND

Golf has long been recognized as a most demanding sport due to the many factors that must be considered by a golfer. When playing any one particular shot, a golfer must make the two following determinations: (1) the distance over which the shot is to be played; and (2) which club is preferred by that golfer for playing a shot of that distance. It is widely known that different golf clubs are provided for hitting a golf ball different distances, yet those skilled in golf will appreciate that different golfers may hit the same club for different distances. Thus, this second determination set out above is an individual one, depending on the ability of the particular golfer playing the shot.

Many devices are known in the prior art for informing a golfer of the distance over which a particular shot is to be played. For example, it is conventional to provide a marker on a golf hole at a distance of one hundred and fifty (150) yards from the green. It is well known that professional golfers "chart" or make notes about a golf course so that they will know distances from various landmarks to the greens or other target areas. Furthermore, devices have been provided as shown in U.S. Pat. Nos. 3,820,786; 3,937,466; and 3,949,987; wherein scaled maps are provided with various indicia that assist the golfer in approximating the distance from his or her present position to the green or other target area.

However, such prior art devices are of little or no assistance in making the second determination, namely—selecting the preferred club. For example, assume two golfers are faced with an identical shot of 150 yards. The first golfer, perhaps more accomplished than the second, might ideally select a 7-iron. The second golfer might ideally select a 5-iron. Thus, simply being made aware of the distance over which the shot is to be played is only of minimal value. The golfer must also be aware of his or her own ability to play each club in order to make the second determination.

Additionally, those skilled in golf will appreciate that each golfer may have his or her own consistent ball flight pattern. For example, certain golfers may regularly pull or "hook" the ball, whereas other golfers may regularly push or "slice" the ball. Thus, the second determination includes not only a knowledge of one's ability to hit a golf ball a certain distance with a particular club, it further includes a knowledge of one's usual ball flight pattern.

Traditionally, the skill of selecting the preferred club according to one's own ability was acquired only through experience. The prior art has heretofore lacked a device and a method for informing a golfer of the distance over which a shot is to be played, and for assisting the golfer in selecting the preferred club to be used to play a shot of that distance according to that golfer's individual ability.

SUMMARY OF THE INVENTION

The present invention solves the above-described problems in the prior art by providing a golfer's aid that not only informs the golfer of the distance over which a particular shot is to be played, but further provides that golfer with an apparatus and method for selecting the preferred club to be played by that golfer for a shot of that distance. The present invention, therefore, unlike the devices of the prior art, considers the ability of an individual golfer to play each golf club.

Generally described, the apparatus of the present invention comprises a scaled map of the particular hole to be played, a shooting pattern for the individual golfer corresponding to that golfer's ability to play each golf club, and means for comparing said shot chart to said scaled map whereby the golfer is informed of the distance over which a particular shot is to be played and provided with information for determining which club is preferred by that golfer for playing a shot of that distance.

Generally described, the method of the present invention comprises developing a shooting pattern for an individual golfer corresponding to that golfer's ability to play a discrete number of golf clubs, and comparing the shooting pattern to a scaled map of a golf hole so as to provide the individual golfer with the distance from his present position to the target area, and to provide a showing of which club is preferred by that golfer for playing a shot of that distance.

Thus, it is an object of the present invention to provide an improved golfer's aid apparatus.

It is a further object of the present invention to provide a golfer's aid that informs a golfer of the distance from his present playing position to a green or other target area.

It is a further object of the present invention to provide a golfer's aid that corresponds to an individual golfer's ability.

It is a further object of the present invention to provide a golfer's aid that informs a golfer of which golf club is preferred for playing a golf shot of a known distance, according to the ability of that individual golfer.

It is a further object of the present invention to provide a method for developing a shooting pattern for a golfer corresponding to the ability of that golfer to play a discrete number of golf clubs.

It is a further object of the present invention to provide a method for selecting the preferred golf club for a golfer playing a particular shot according to the abilities of that golfer.

Other objects, features, and advantages of the present invention will become apparent from a reading of the following specification when taken in conjunction with the following drawing.

DETAILED DESCRIPTION

Figure 1:
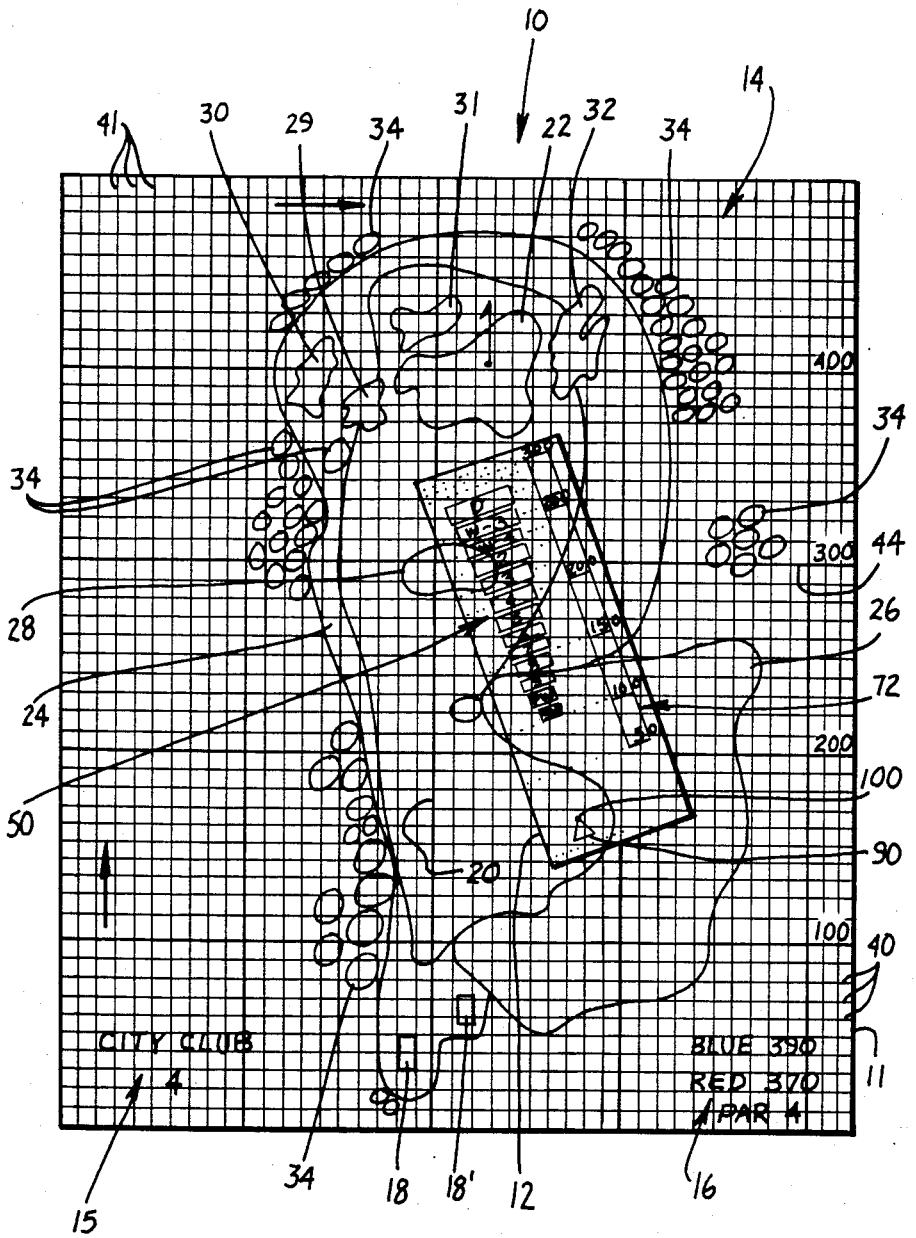
FIG. 1 is a plan view showing a shooting pattern developed according to the present invention disposed on a transparent sheet, and further showing the transparent sheet placed on a scaled, map diagram of a particular golf hole.

Referring now in more detail to the drawing, in which like numerals indicate like parts throughout the several views, FIG. 1 shows a golfer's aid apparatus 10 according to the present invention. The preferred embodiment of the golfer's aid 10 provides an opaque sheet member 11, and a transparent sheet member 12. As described in detail hereinbelow, these two sheet members 11 and 12 provide a novel combination that facilitate the apparatus and method of the present invention.

Figure 2:
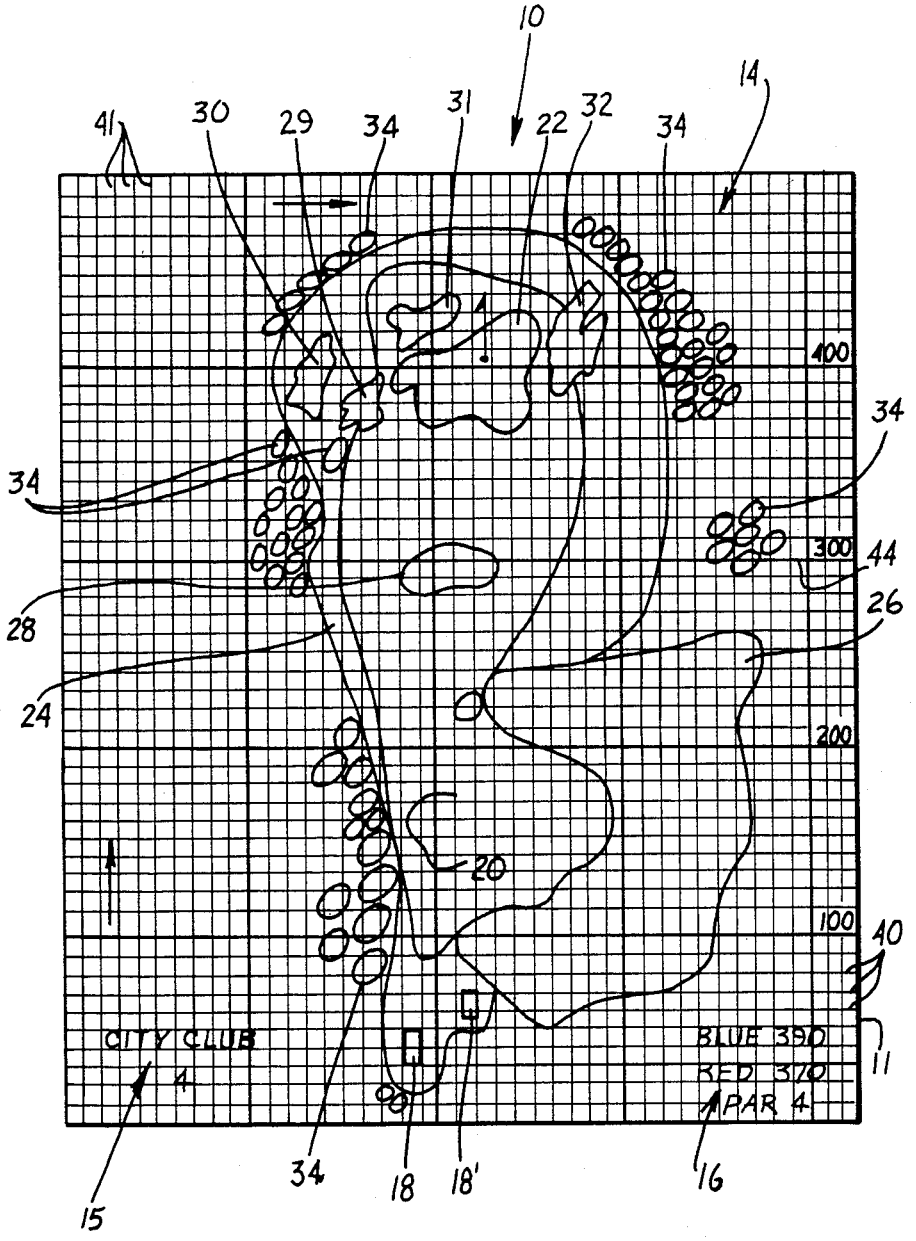
FIG. 2 is a plan view of the scaled, map diagram shown in FIG. 1.

As shown in FIG. 2, the opaque sheet member 11 provides a diagram 14 of a golf hole. It is to be understood that the golf hole diagram 14 constitutes a two-dimensional representation of an actual hole on a golf course. The hole diagram 14 provides hole recognition indicia, indicated generally at 15. As shown in the drawing, the hole recognition indicia consists of the name of the golf course, "CITY CLUB", and the number of the golf hole, "4". Of course, the recognition indicia 15 may be varied depending on the golf course and the golf hole diagrammed. The hole diagram 14 also provides hole specification indicia, indicated generally at 16. The hole specification indicia 16 provides the distance of that hole, and the number of strokes permitted in order to make par for that hole. As shown in FIG. 2, the length of the hole is 390 yards when played from a first tee area 18, and 370 yards when played from a second tee area 18'. Those skilled in the sport of golf will appreciate that the tee is traditionally that location from which the golfer plays his initial shot on the hole, and that the provision of two tees 18 and 18' is well known. Conventionally, the first tee area 18 is referred to as the "blue tee" or the "men's tee", and the second tee area 18' is referred to as the "red tee" or the "ladies tee". Further to the hole specification indicia 16, it is seen that par for the present hole is "4". Thus, in keeping with the conventions of the sport, the golfer must play this hole in four (4) shots to make par.

The hole diagram 14 shown in FIG. 2 further provides a fairway region 20 and a green 22. The fairway region 20 traditionally provides a mowed grassy surface, and therefore, represents the area from which the golfer prefers to play. The green 22 includes the hole containing the usual flag pin and constitutes the putting surface. Surrounding the fairway 20 and the green 22 are a number of hazard areas. Generally speaking, a hazard area comprises an area from which it is difficult to play a golf shot. One such hazard area, denoted as 24 on the drawing, is provided at the outer edge of the fairway 20. This hazard area 24 is commonly referred to as the "rough", and comprises a region of high or perhaps uncut grass. A second hazard area shown on the hole diagram 14 is a lake 26. Of course, should a golfer hit his or her ball into the lake 26, the ball is unplayable and the shot is replayed with a conventional stroke penalty.

Another hazard shown on the diagram 14 is a plurality of sand traps 28, 29, 30, 31 and 32. Each sand trap 28—32 conventionally consists of a sand-filled region from which it is difficult to play a shot. Yet another hazard shown on the diagram 14 is a plurality of trees 34. Of course, the trees 34 obstruct the flight of a golfer's shot. Thus, it is seen that while the hole diagram 14 shows only one hole, it may be adapted to any golf hole. Furthermore, FIG. 2 fully demonstrates how any such golf hole, including hazards, may be two-dimensionally represented by such a hole diagram 14.

Further to FIG. 2, the hole diagram 14 is preferably plotted on a cartesian coordinate system. The cartesian coordinate system is defined by a plurality of horizontal lines 40 and a plurality of vertical lines 41. Preferably, the coordinate system defines units indiciating ten (10) yards of distance between each line 40 or 41. Furthermore, certain lines indicating certain distances may be darkened and labeled. For example, horizontal line 44 is labeled "300", corresponding to a distance of three hundred (300) yards from the back edge of the hole. For the reasons set forth below, the cartesian coordinate system of the hole diagram 14 must be provided according to a scale identical to that of the other components of the invention. Thus, the cartesian coordinate system of the hole diagram 14 must accurately represent the actual distances between landmarks on the actual hole.

Figure 3:
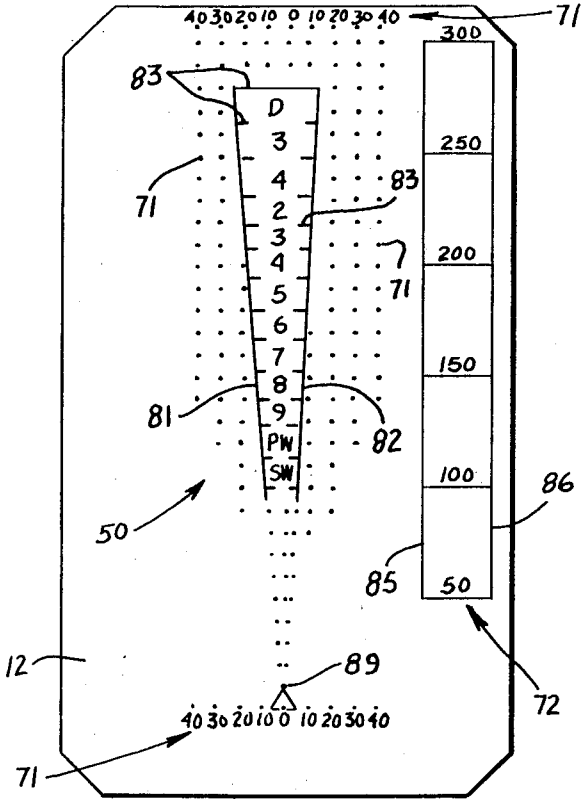
FIG. 3 is a plan view of the transparent sheet shown in FIG. 1.
Figure 4:
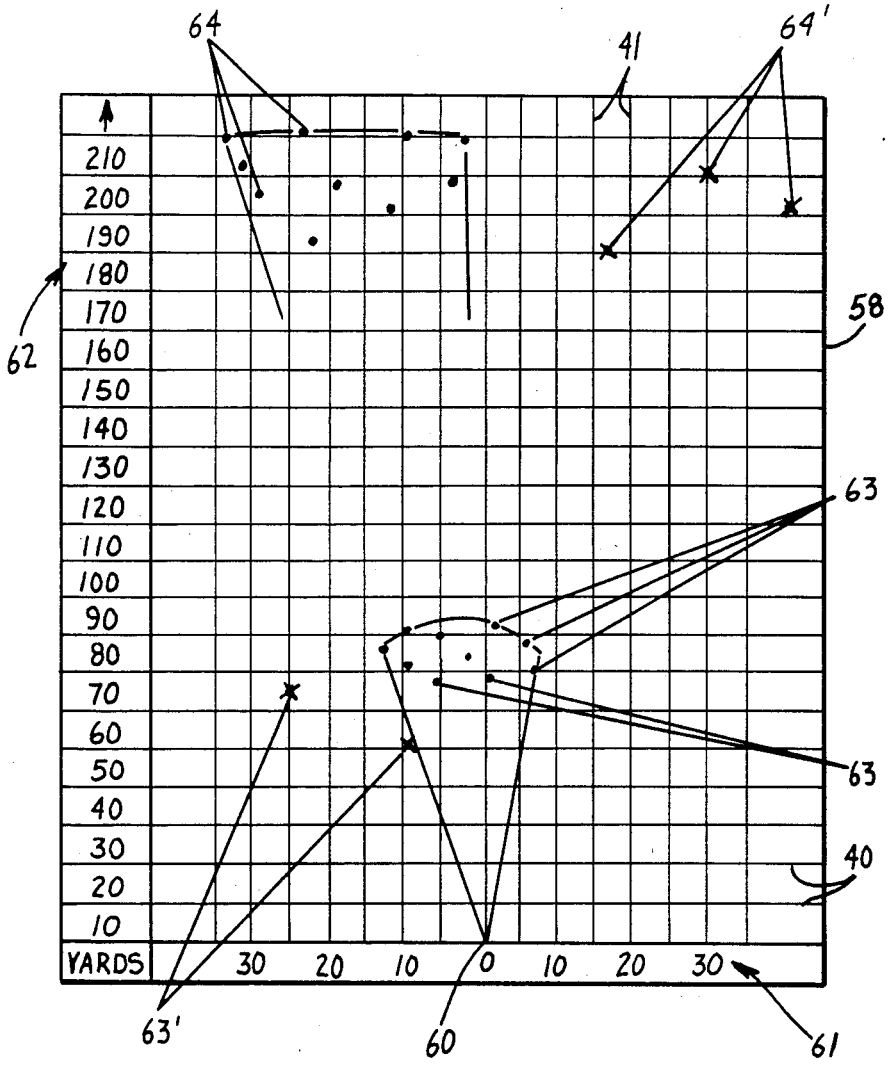
FIG. 4 is a plan view of a driving range plot diagram according to the present invention.

The preferred transparent overlay sheet 12 for an individual golfer is shown in FIG. 3. The overlay sheet 12 provides a shooting pattern diagram 50 for that golfer, and a yardage indicator 72. As described in detail below, the shooting pattern diagram 50 is a visual summary of that golfer's ability to play each club in terms of average distance and average range of dispersion. The shooting pattern diagram 50 is produced from a shot chart 55, shown in FIG. 5 and described below. The shot chart 55 is, in turn, produced from a driving range plot diagram 58, shown in FIG. 4.

The preferred driving range plot diagram 58 provides a cartesian coordinate system defined by a plurality of horizontal lines 40 and a plurality of vertical lines 41, and includes a (0,0) point 60. The (0,0) point 60 is referred to as the present position point. The coordinate system is further comprised of ten (10) yard delineations in the X direction (indicated generally as 61), and ten yard delineations in the Y direction (indicated generally as 62). As described below, the X direction delineations constitute dispersion indicia, and the Y direction delineations constitute distance indicia. Of course, smaller or larger delineations could be provided depending on the accuracy desired.

It is to be understood that the plot diagram 58 coordinate system corresponds to a grid pattern that is provided on an otherwise conventional golf ball driving range. This grid pattern may comprise a tarp that is placed over the ground surface, or may be made by marking a cartesian coordinate system (X direction and Y direction delineations 61 and 62, respectively) directly on the ground surface. These markings may be chalked, painted, or may utilize any other conventional turf marking. Once this grid pattern is in place on the surface of the driving range, the golfer to be charted selects a club and is provided with a certain number of golf balls. The golfer hits all of these golf balls with the club selected, from a point on the driving range corresponding to the present position point 60 on the plot diagram 58. The final position for each ball is marked on the plot digram 58. The number of golf balls hit by a golfer may vary. However, the golfer must hit a statistically meaningful number of golf balls. A statistically meaningful number is obtained when a desired level of consistency in the final positions of the golf balls is obtained by the golfer. Mathematical techniques for determining the number of balls necessary to provide a selected degree of statistical confidence are known to those skilled in the art.

This operation is repeated for each club. Conventionally, the clubs to be hit include, a sandwedge, a pitching wedge, a 9-iron, an 8-iron, a 7-iron, a 6-iron, a 5-iron, a 4-iron, a 3-iron, a 2-iron, a 4-wood, a 3-wood, a 2-wood and a 1-wood or driver. Of course, other clubs may also be hit, or some of those set forth above may be omitted. The plot diagram 58 shown in FIG. 4 demonstrates the above-described operation for two different clubs; a pitching wedge and a 3-iron. The final position or result of those balls hit with the pitching-wedge is indicated as 63. The final position or result of those balls hit with the 3-iron is indicated as 64. It is to be noted that the final position 64 of those balls hit with the 3-iron fell somewhat to the left of final positions 63 of those balls hit with the pitching-wedge.

Figure 5:
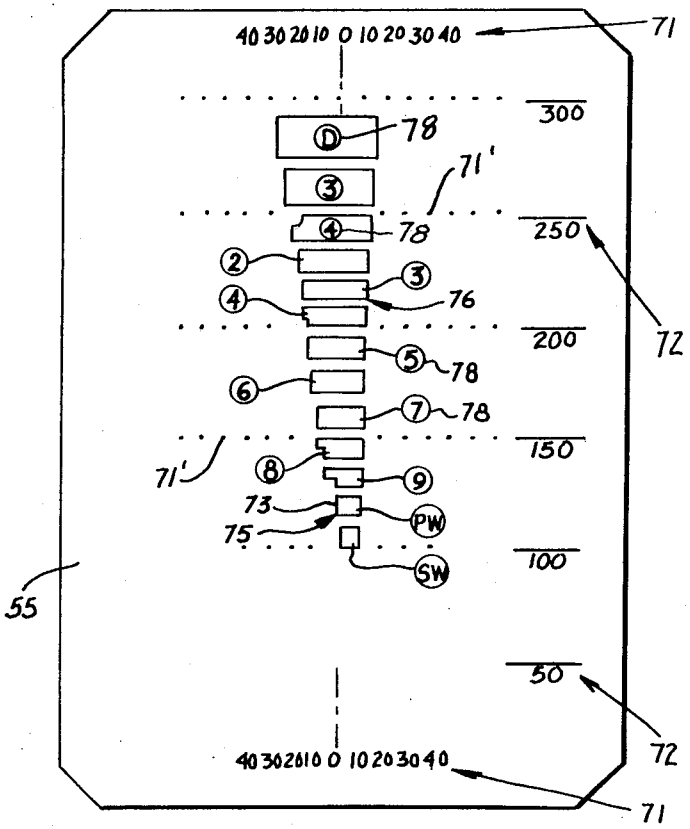
FIG. 5 is a plan view of a shot chart according to the present invention.

Thus, it is seen that the driving range plot diagram 58 is a collection of raw data concerning the ability of the golfer to play those clubs selected for charting. From this collection of raw data, a shot chart 55 is prepared. The preferred shot chart 55 is shown in FIG. 5. The shot chart 55 provides a modified cartesian coordinate system with dispersion indicia 71 corresponding to the X direction delineations 61 of the plot diagram 58, and distance indicia 72 corresponding to the Y direction delineations of the plot diagram 58. The dispersion indicia 71 are provided by numerical values at the top and bottom of the shot chart, and further provided by dots 71' at discrete intervals throughout the shot chart 55. These intervals are set forth in delineations of 50 yards by the distance indicia 72 on the right hand side of the shot chart 55.

To generate the shot chart 55 shown in FIG. 5, a statistical analysis is performed on the raw data contained in the driving range plot diagram 58. Generally stated, this analysis consists of eliminating or disposing of those results that represent error. Described somewhat more particularly, this analysis consists of eliminating or disposing of those results that differ so significantly from the mean of the other or remaining results that they do not provide a true indicator of how the individual golfer usually plays that particular club. Thus, the shot chart 55 represents a compilation of relevant statistical data. Continuing with the example of the pitching-wedge and 3-iron, the plot diagram 58 shows these results at 63 and 64, respectively. However, for the pitching-wedge, two results, indicated as 63', are removed from the general area of the other results. Excluding those results 63', this golfer usually hits his pitching-wedge a distance of 65 to 85 yards (as shown by the remaining results). The results indicated as 63' have been deemed to be error, and thus eliminated. Similarly, those results indicated at 64' were eliminated in consideration of the 3-iron results.

Once this statistical analysis is performed for each club, a range of distance and dispersion may be calculated. For example, the range of the pitching-wedge results 63 shown in the plot diagram 58 show a distance of from 65 yards to 85 yards, and a dispersion of from +7 to −12 yards. The area defined by these values is then traced onto the shot chart 55. For example, the area wherein this golfer will usually play his pitching-wedge is indicated generally at 75, and the area where he will usually play his 3-iron is indicated generally at 76. The above-described operation is performed for each club to provide the shot chart 55 as in FIG. 5. A club indicia 78 is provided to inform as to which club was played to obtain that group of results.

The shot chart 55 therefore represents a compilation of statistically relevant results obtained by a particular golfer according to his or her own ability. The preferred shot chart 55 provides a plurality of defined areas corresponding to these statistically relevant results. Continuing with the example of the pitching-wedge and 3-iron, a block 73 and a block 74 is provided that includes or encircles all of the statistically relevant balls hit with the pitching wedge and the 3-iron, respectively. The other blocks on the shot chart 55 correspond to similar results obtained for different clubs, each club being indicated on the drawing. In keeping with the example, it is to be noted that this golfer appears to pull his shots more to the left as the distance increase; in other words, as the longer hitting clubs are played.

Once the shot chart 55 is completed, this information is transferred to the transparent overlay sheet 12 to form the shooting pattern 50. The preferred transparent overlay 12 is shown in FIG. 3. The overlay 12 is made of a sheet of transparent material, and provides the shooting pattern 50 and the yardage indicator 72 spoken of above. The shooting pattern 50 represents a compilation of the information provided by the shot chart 55, and is mapped onto a modified cartesian coordinate system identical in scale to that provided by the shot chart 55. Thus, the shooting pattern 50 is set out on a modified cartesian coordinate system having dispersion indicia 71 and distance indicia 72. Dotted indicia 71' is also provided, and as with the shot chart 55, corresponds to the distance indicia 72 of the yardage indicator 52 on the right hand side of the overlay sheet 12. However, it is to be noted that the dotted indicia 71' that indicate distance on the overlay sheet 12 is provided in delineations of ten (10) yards as opposed to the delineations of fifty (50) yards on the shot chart. Further to the modified cartesian coordinate system shown on the overlay sheet 12, a (0,0) point 89 is provided with a triangular indicium 90 to further delineate the (0,0) point 89. This point 89 corresponds to the present position point 60 provided by the driving range plot diagram 58.

To generate the shooting pattern 50, those lines on the shot chart 55 corresponding to the range dispersion are joined to provide the two range dispersion lines 81 and 82 (as shown in FIG. 3). Similarly, those lines on the shot chart 55 corresponding to the distance for each club are united to form the distance lines 83 (as shown in FIG. 3). The indicia 78 shown on the shot chart 55 corresponding to the club played to obtain these results is simply transferred therefrom to the shooting pattern 50. Additionally, the yardage indicator indicium 72 is provided with two vertical lines 85 and 86 to produce a yardage indicator as shown in FIG. 3. It is to be noted that the shooting pattern 50 shown in FIG. 3 reflects the golfer's tendency to pull his shots to the left when playing the longer hitting clubs.

In use of the present invention, a golfer first produces his or her own plot diagram 58 according to the description above. The statistically relevant results of that plot diagram 58 are selected to provide a shot chart 55 for that golfer. The shot chart 55 is then utilized to provide a shooting pattern 50 on a transparent overlay 12. The shooting pattern 50 is set out on a modified cartesian coordinate system that corresponds to a yardage indicator 72 as shown in FIG. 3. Additionally, a hole diagram 14 is prepared as shown in FIG. 2; the hole diagram 14 being plotted on a scale identical to that of the shooting pattern 50 and yardage indicator 52 provided on the overlay sheet 12.

To begin play of the hole, the golfer places the transparent overlay 12 on the opaque sheet member 11 so that the (0,0) point 89 rests upon the tee 18 or 18' from which the golfer is to hit his first shot. As shown by FIG. 1, the golfer can readily see where his or her tee shot will most likely land on the hole by viewing the opaque sheet member 11 through the transparent overlay sheet 12. Thus, if the golfer uses a driver, his shot will most likely land in that area denoted "D" by the indicia 78. Similarly, if the golfer uses a 7-iron, his shot will most likely land in that area denoted "7" by the indicia 78.

To further demonstrate the preferred embodiment of the present invention, assume a golfer must play a shot from a point on FIG. 1 denoted as 100. As can be seen from the hole diagram 14, to hit his next shot towards the green 22, the golfer must hit over the lake 26. To select the proper club to play this shot, the golfer places the overlay sheet 12 on the hole diagram 14 with the present position point 89 directly over that point 100 corresponding to the position of his ball on the fairway. The golfer then positions the shooting pattern 50 provided on the overlay sheet towards the green 22 (as shown in FIG. 1). When the overlay sheet is properly positioned, the golfer can readily see that he must hit the ball a minimum of 100 yards to clear the lake 26. Furthermore, the overlay sheet 12 shows that if he selected and played either a sandwedge, pitching wedge or 9-iron, his ball would land in the lake 26. Furthermore, if he selected and played either a 3-iron, a 2-iron, or a 4-wood, the likelihood of his hitting into the sand trap 28 in front of the green 22 is high. Thus, the preferred club to be selected by this golfer for this shot is a 3-wood. (Those skilled in the art will appreciate that while a driver may also be selected, it would not be a preferred club with which to play a fairway shot.)

Thus, it is seen that the present invention provides three separate indicia that informs a golfer of the distance over which a shot is to be played. First, the hole specification indicia 16 informs the golfer of the distance from tee 18 or 18' to green 22. Second, the hole diagram 14 includes a scaled coordinate system from which a golfer may deduce the distance from a particular position to the green 22, a hazard, a landmark or some other target area. Third, the overlay sheet 12 provides a yardage indicator 72 that may be placed on the hole diagram 14 to determine a distance.

Furthermore, it is seen that unlike any prior art device, the present invention provides an apparatus and method for determining the preferred club to be selected for playing a particular shot by an individual golfer according to his or her own ability. The apparatus of the present invention provides a shooting pattern 50 on the transparent overlay sheet 12 that corresponds to the ability of that golfer to play each club in terms of average distance and range of dispersion. According to the method of the present invention, the golfer places the shooting pattern 50 onto the hole diagram 14 at the present position of his or her golf ball 60, and determines the preferred club to be played according to the indicia 78 provided by the shooting pattern 50.

It should be understood that the foregoing relates only to a preferred embodiment of the present invention, and that numerous modifications or alterations may be made therein without departing from the spirit and scope of the invention as set forth in the appended claims.

I claim:

1. A golfer's aid apparatus, comprising:

a sheet member having markings disposed thereon comprising a diagram of an actual golf hole to be played by a golfer, said golf hole diagram including markings corresponding to the tee area, fairway, green, hazards and landmarks of said actual golf hole disposed onto orthogonal indicia comprising a plurality of uniformly spaced apart increments of distance according to a selected scale; and a transparent overlay having a shooting pattern disposed thereon comprising a schematic representation of the ability of said golfer to play each of a defined set of golf clubs, said shooting pattern defining a plurality of discrete areas provided according to said selected scale, each of such areas being identified by indicia corresponding to the indicia designating said golf clubs and further and corresponding to the average range of distance and average range of dispersion achieved by said golfer upon hitting a predetermined number of golf balls with said designated golf club, whereby placement of said transparent overlay onto said sheet member in such a manner as to superimpose said shooting pattern of said golfer onto said golf hole diagram provides a visual comparison of said golfer's shooting pattern to said hole diagram, such that said golfer determines the preferred club with which to to play a particular shot by selecting the club corresponding to the club designation of the area disposed immediately above a target area.

2. A method of determining the preferred club to be selected by a golfer to play a particular golf shot comprising the steps of:

providing an opaque sheet member having disposed thereon a diagram of an actual golf hole to be played by a golfer, said sheet member having disposed thereon an orthogonal coordinate system according to a selected scale and said diagram including a proportional representation of the tee, the green, the fairway, the hazards and the landmarks of said actual golf hole;

providing a transparent sheet member having disposed thereon a shooting pattern comprising a diagram of how said golfer typically plays each of a selected set of golf clubs, said shooting pattern comprising a present position point and a plurality of discrete expected landing areas emanating therefrom, each of said expected landing areas being identified by indicia corresponding to a particular club designation corresponding to one of said clubs of said set of clubs, and defined by a distance range and a dispersion range corresponding to the distance range and dispersion range over which said golfer previously hit a predetermined number of golf balls with said designated club;

disposing said transparent sheet member over said opaque sheet member such that said present position point of said shooting pattern is visually disposed on the golf hole diagram at the position from which the golfer must play a next shot on the actual golf hole;

aligning said shooting pattern on said transparent sheet member towards a target area on the golf hole diagram; and determining visually the preferred club to be selected to play said next shot by selecting the club according to the club designation of the expected landing area on the shooting pattern disposed immediately above the target area on said golf hole diagram.

* * * * *